US005795991A

United States Patent [19]

Hesse et al.

[11] Patent Number: 5,795,991

[45] Date of Patent: Aug. 18, 1998

[54] ARRANGEMENT OF AN IMPACT-SENSITIVE DEVICE IN A HOUSING

[75] Inventors: Alfons Hesse; Franz-Josef Puttman, both of Lennestadt, Germany

[73] Assignee: Tracto-Technik Paul Schmidt Spezialmaschinen, Lennestadt, Germany

[21] Appl. No.: 697,414

[22] Filed: Aug. 23, 1996

[30] Foreign Application Priority Data

Aug. 23, 1995 [DE] Germany ..... 195 30 973.1
Sep. 20, 1995 [DE] Germany ..... 195 34 806.0

[51] Int. Cl.[6] ..... G01N 3/00

[52] U.S. Cl. ..... 73/12.09; 73/152.59

[58] Field of Search ..... 73/12.09, 152.45, 73/152.02, 152.59

[56] References Cited

U.S. PATENT DOCUMENTS

| | | | |
|---|---|---|---|
| 3,714,831 | 2/1973 | Quichaud et al. | 73/431 |
| 3,714,931 | 2/1973 | Quichaud et al. . | |
| 4,120,198 | 10/1978 | Tanguy et al. | 73/152.48 |
| 4,265,305 | 5/1981 | Stone et al. | 73/431 X |
| 4,266,606 | 5/1981 | Stone | 73/152.46 X |
| 4,454,756 | 6/1984 | Sharp et al. | 73/152.54 |
| 4,491,738 | 1/1985 | Kamp | 73/152.46 X |
| 4,537,067 | 8/1985 | Sharp et al. | 73/152.13 |
| 5,136,525 | 8/1992 | Cloud . | |
| 5,214,251 | 5/1993 | Orban et al. | 73/152.18 X |
| 5,526,886 | 6/1996 | Jenne | 175/45 |

FOREIGN PATENT DOCUMENTS

| | | |
|---|---|---|
| 0 361 805 | 4/1990 | European Pat. Off. . |
| 2 043 941 | 3/1971 | Germany . |
| 39 43 151 | 7/1991 | Germany . |
| 2 113 852 | 8/1983 | United Kingdom . |
| 2 238 809 | 6/1991 | United Kingdom . |

*Primary Examiner*—Elizabeth L. Dougherty
*Attorney, Agent, or Firm*—Merchant, Gould, Smith, Edell, Welter & Schmidt, P.A.

[57] ABSTRACT

Arrangement of an impact-sensitive device in a housing, particularly a transmitter for locating a drilling device located in a borehole in the ground, wherein the device is maintained within same by means of at least one impact-damping buffer at least in the main direction of impact and at a distance from the wall of a chamber accommodating the device.

16 Claims, 3 Drawing Sheets

ARRANGEMENT OF AN IMPACT-SENSITIVE DEVICE IN A HOUSING

The invention relates to the arrangement of an impact-sensitive device inside a housing, in particular a transmitter for locating a drill device moving inside a borehole in the ground.

Such drilling devices are known, for example, from the German Offenlegungsschrift 39 00 122 and the European Offenlegungsschrift 0 361 805. Their transmitters have, as a rule, an inclination sensor, a temperature detector, a rotation error sensor, a transmitting antenna and batteries or rechargeable storage batteries. These elements are arranged inside a probe housing with a cover made of a synthetic material or steel which is rigidly attached in an axial bore of the housing of the drilling device.

While the ground drilling takes place, the drilling device can be tracked above the ground due to the signals sent by the transmitter by means of a hand-held receiver or several stationary receivers. To ensure that the transmitter can transmit through the walls of the housing of the device across greater distances, the housing is provided with, for example, four transmission slits 1 to 5 mm wide which are distributed along the circumference and which are closed by means of a synthetic filling material.

The advance of such drilling devices is either through rotary action and/or impact with the result that the drilling device and the transmitter arranged therein are subjected to high dynamic loads. At this time, the transmitter is influenced by, on the one hand, an axial acceleration force due to the rammer and rapid translatory motion, particularly against hard resistances, and, on the other, a radial accelerating force which is created when the drill becomes lodged in stone, or when the drill pipe driving the drilling device by rotation receive a torsional prestress due to the rotary drive when the drill head is suddenly released or, possibly, again becomes lodged.

Such strong accelerating forces result in damage to the transmitter or its components and particularly also to the power supply after a short period of use. Since, as a rule, batteries are used for the power supply of the transmitter, they slam against each other and against the housing due to the high axial accelerating forces, the battery poles become displaced, the batteries are damaged, and the contact interrupted.

Since the failure of the transmitter occurs mostly in deep and hard layers of soil where the highest dynamic loads are found, this means that the drilling device or also the entire drill pipe must be pulled back with the drilling device and disassembled. The transmitter must then be exchanged and the drilling operation restarted. This process becomes particularly lengthy when the device does not hit the old drilling channel, possibly still existing at least in part, but a completely new borehole must be created.

When the drilling device is advanced within the borehole in the soil with the aid of drilling fluid, directed via the drill pipe up to the drilling device, it is important to keep this drilling fluid away from the transmitter. It is possible for the drilling fluid to penetrate into the interior of the housing via a joint between the steering head, mounted on the housing in replaceable fashion, and the housing, as well as through the transmitter slits, when the synthetic sealing material has become detached from the slit wall and falls out. This may result in increased impact transfer to the transmitter and a failure on the part of the transmitter due to the penetration of liquid.

SUMMARY OF THE INVENTION

It is the task of the invention to create an arrangement by means of which impacts and possibly drilling fluid are kept away from the impact-sensitive device in the housing, in particular the transmitter for locating a drilling device moving inside a borehole inside the earth.

Based on this task, in an arrangement of the initially mentioned type, it is proposed that the impact-sensitive device be kept, by means of at least one impact-damping buffer, at a distance from the wall of the chamber accommodating the device, at least in the main direction of impact. The impact-sensitive device may be embedded in the impact-damping buffer or, when it involves a cylindrical transmitter, the impact-sensitive device may be kept at a distance from the wall by means of a buffer arranged at each end.

As a buffer material, preferably silicone rubber with a Shore A hardness of 15 to 30 is used, which has excellent oscillation- and impact-damping properties, which change little across a broad temperature range. Also, the good electrical insulating ability is advantageous.

The impact-damping effect of the buffers in the axial and radial direction is advantageously of such a nature that at least one buffer has a greater diameter than the device and the other buffer has annular grooves.

The annular grooves influence the axial elasticity and deformability of the buffers during axial as well as radial acceleration.

When the buffer is attached in the device by means of at least one pin gripping into a borehole inside the buffer and by means of a snap connection formed between the buffer and the device, where a head on the pin grips into an undercut of the borehole, it is possible for the buffer to be easily connected to or disconnected from the device due to its deformability in order, for example, to service the device. In order to pull the device out of the housing, a pulling hook merely needs to be guided into the undercut in order to then grip the device at the buffer and to be able to pull it out.

In order to enable the device to send a signal that indicates a rotation error to the ground surface, the device must be arranged in the housing without rotational play. For this purpose, at least one of the buffers is connected to the device without rotational play and has an external longitudinal groove, into which a projection on the housing accommodating the device grips to secure against turning. At the other end of the device, a slit, accessible through the borehole of the other buffer, may be arranged for the purpose of positioning tools, for example, a screwdriver.

The connection to the housing without rotational play may also be achieved in that the device is connected to a steering head without rotational play via a torsionally elastic guide rod, which steering head itself is coupled to the housing without rotational play, wherein the guide rod, at its one end, grips via a tab into a front groove at the steering head and is secured, against its being pulled out due to its cross section, while the guide rod, at its other end, grips into a T-groove at the device with a T-tongue. In this way, the complete transmitter can be pulled out of the housing by means of the steering head and, for that purpose, neither a pulling hook nor a screwdriver is necessary for the alignment of the transmitter.

When the T-tongue inside the T-groove exhibits axial play which is greater than the maximally resulting range of elasticity of the buffer and the guide rod is arranged with play inside the borehole of the buffer, the device can oscillate freely without sustaining harmful impact.

Since a drilling device driven by drill pipes is relatively long, it is possible for the drilling device to bend during steering movements, particularly in the presence of very hard soil formations. In order to prevent the cylindrical housing of the impact-sensitive device from coming into contact with the wall of the chamber inside the housing and from becoming stuck, it is advantageous to arrange on the device adjacent to the buffers impact-damping guide rings which may be relatively narrow and have a diameter which is greater than the device by up to 5 mm. In this way, the device can be prevented from becoming stuck during the bending of the drilling device, so that the radial acceleration forces cannot be transferred to the device.

The batteries or rechargeable storage batteries serving as the power supply have a relatively great mass and contact problems between the batteries and the device (transmitter) when particularly high axial accelerations occur. In order to prevent this, it is possible to arrange impact-damping buffers on both sides of a battery arranged in a battery compartment inside the device. If two batteries are arranged coaxially in the battery compartment, the impact-sensitive buffers are arranged preferably on both sides of the batteries, as well as between the batteries and have an annular form so that the battery contacts and/or contact springs can grip through them.

In order to prevent the synthetic filling material that is arranged in the transmitter slits from being separated during the bending of the housing of the drilling device, the transmitter slits may be reinforced by means of crosspieces.

A penetration of drilling fluid from a steering head, attached at the housing, into the device (transmitter), arranged in the housing, can be prevented when at the steering head a lip seal is present, providing a seal with respect to the housing.

BRIEF DESCRIPTION OF THE DRAWING

The invention is explained in greater detail in the following text by means of an example shown in the drawing. In the drawing.

DETAILED DESCRIPTION OF PREFERRED EMBODIMENTS

Figure 1:
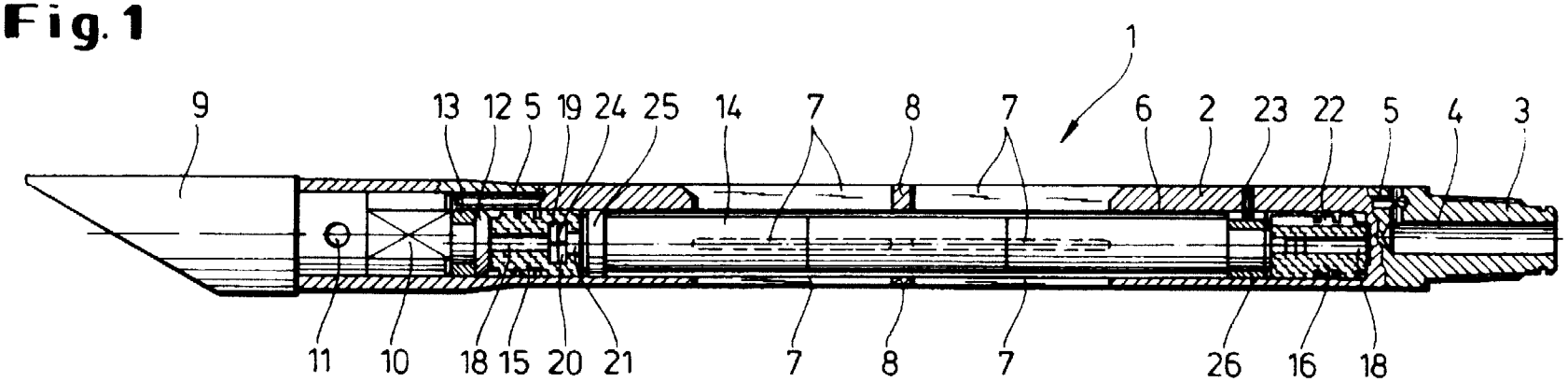
FIG. 1 shows a drilling device with a transmitter arranged therein in an axial, longitudinal section
Figure 2:
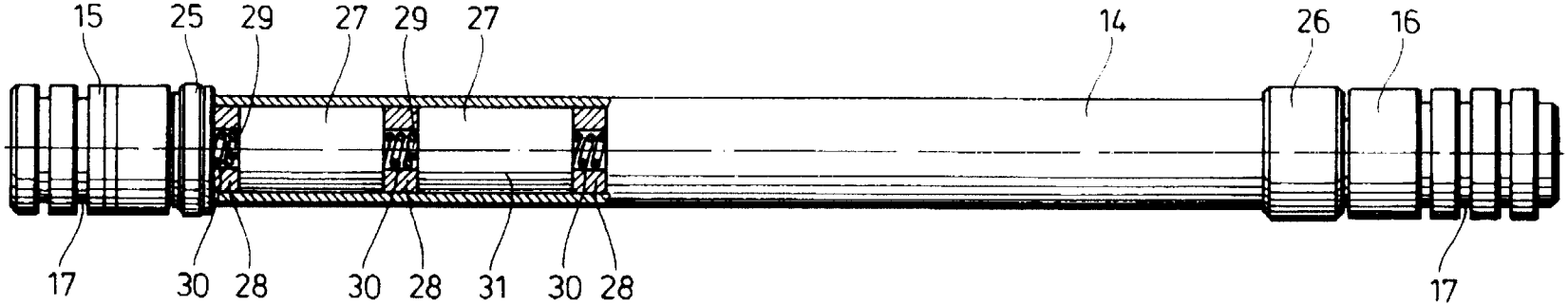
FIG. 2 shows the enlarged representation of a cylindrical transmitter with buffers arranged at the ends, in partial cross section.

The drilling device (1) consists of a housing (2) whose rear end (3) is provided with threads for the attachment of drill pipes (not shown). By means of a central borehole (4) in the rear end (3) and an eccentric borehole (5) in the housing (2), drilling fluid is directed to a steering head (9), arranged at the head end of the drilling device (1).

A cylindrical chamber (6) for a transmitter (14) is located in the housing (2). In the area of the chamber (6), transmission slits (7) are arranged so that the transmitter (14) can transmit through the drilling device wall across greater distances.

These transmission slits (7) are approximately 1 to 5 mm wide, extend axially essentially across the length of the transmitter (14) and are reinforced with one or several crosspieces (8) in order to prevent that slit filling, not shown and made of a synthetic material or another suitable material, from falling out of the transmission slits (7) when the drilling device (1) becomes deformed due to strong torsional forces or during steering movements.

The steering head (9) with a sloping surface is connected to the housing (2) without rotational play in such a way that flat areas (10) are retained by corresponding projections in the housing (2). The steering head (9) is secured against axial displacement by means of a pin gripping through a borehole (11). A lip seal (13) that prevents drilling fluid directed to the steering head (9) via the borehole (5) from passing into the chamber (6) for the transmitter (14) is arranged at a projection (12) of the steering head (9).

The transmitter (14) has a cylindrical housing whose outer diameter is smaller than the inner diameter of the chamber (6) by approximately 5 mm. A buffer (15) is arranged at the end of the transmitter (14) that faces the steering head (9), and an impact-damping buffer (16) is arranged at the end facing the rear end (3) of the housing (2).

The buffers (15, 16) consist preferably of silicone rubber with a Shore A hardness of 15 to 30; however, they may also consist of other impact-damping elastomers. In order to assure the deformability in the axial and radial direction, the buffers (15, 16) are provided with annular grooves (17) and axial boreholes (18). At least the axial borehole (18) in the buffer (15) has an undercut (19) into which a head (20) of a pin (21), connected to the transmitter (14), grips, whereby the buffer (15) is securely held in the axial direction. The axial extent of the undercut (19) is greater than that of the head (20), so that a free space remains into which a pulling hook can be introduced after the steering head (9) has been removed, so that the transmitter (14) can be drawn from the chamber (6) by means of the pulling hook.

At least the buffer (16) is connected to the transmitter (14) without rotational play and has a longitudinal groove (22) into which a projection in the form of a screw (23) grips at the housing (2). In this way, the transmitter (14) assumes with respect to the housing (2) a defined position which does not change during its operation. Nonetheless, this fixation in position is such that neither axial nor radial accelerations are transferred to the transmitter (14).

In order to be able to introduce the transmitter (14) into the chamber (6) in such a way that the screw (23) grips into the longitudinal groove (22), a transverse slit (24) is arranged at the head (20), so that the transmitter (14) can be turned by means of a screwdriver which is introduced into the slit (24), in order to align the longitudinal groove (22) and the screw (23) with each other.

Adjacent to the buffers (15, 16), impact-damping, narrow guide rings (25, 26), whose outer diameter essentially coincides with the inner diameter of the chamber (6) and which serve to guide the transmitter (14) inside the housing (2), are arranged on the housing of the transmitter (14). In case the housing (2) is deformed, the guide rings (25, 26) prevent radial accelerations from being transferred to the transmitter (14).

Two cylindrical batteries (27) are arranged coaxially in a battery compartment (31) of the transmitter (14). It is also possible that only one or more than two batteries may be involved. Between these batteries (27) and on both sides thereof, additional annular buffers (28), also preferably made of silicone rubber with a Shore A hardness of 15 to 30 are arranged which serve to prevent the transfer of particularly high acceleration forces to the batteries (27). In this case, contact springs (30) serve for the contact transfer from the batteries (27) to the electronic components arranged in the housing of the transmitter (14).

Figure 3:
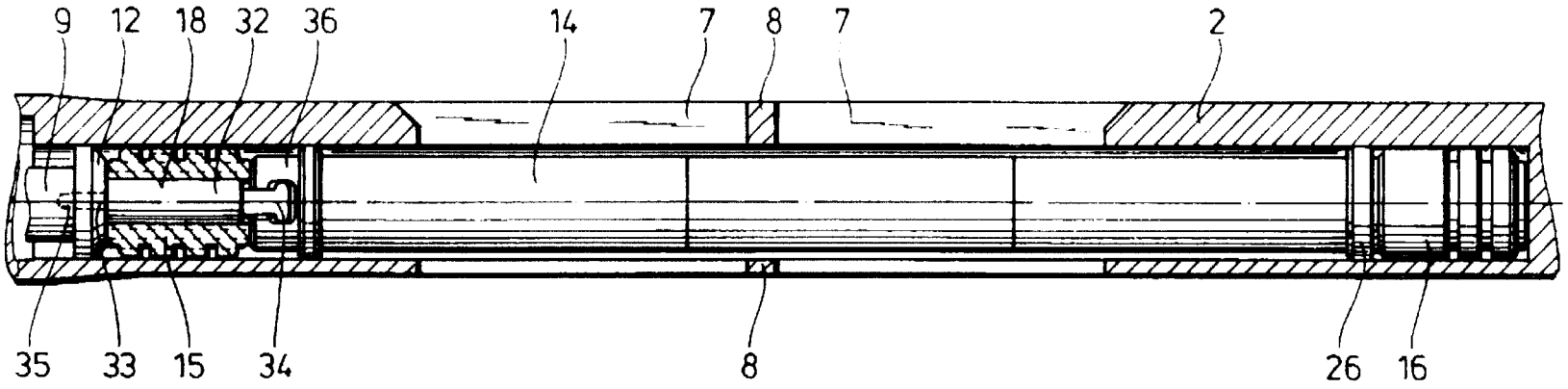
FIG. 3 shows a detail of the connection between a drill head at the drilling device and the transmitter.

In the embodiment according to FIG. 1, the transmitter (14) inside the drilling device is secured against turning by means of a screw (23) that grips into a groove (22). Another embodiment of the very important fixing of the transmitter (14) at the steering head (9) so that it is secured against turning is shown in FIG. 3 and consists of a torsionally elastic guide rod (32) that engages with a buffer (15) that connects the transmitter (14) to the steering head (9).

For this purpose, the buffer (15) has the axial borehole (18).

The connection |of the| steering head (9) |and| rod (32), may, for example, take place via a tab (33) which grips into a front groove (35) at the steering head (9). By means of its cross section, the tab (33) may be secured against being dislodged. The connection |of the| rod (32) |and| transmitter (14) may take place via a T-tongue (34) at the rod (32) which grips into a T-groove (36) at the transmitter (14). It is important that the T-groove (36) at the transmitter (14) be laid out in such a way that at the front, the rod (32) has sufficient axial play in this groove (36). The axial play must be greater than the maximally resulting range of elasticity of the buffers (15, 16). Since the rod (32) is attached at the transmitter via the T-tongue (34) and via the tab (33) at the steering head (9), the entire transmitter (14) can be pulled out of the axial borehole by means of the steering head (9). No additional tools, such as a pulling hook or screwdriver, are required for extraction or introduction purposes.

Since the rod (32) is torsionally elastic, no hard blows, as may occur, for example, during the hooking of the steering head (9), will be transferred to the transmitter (14). The rod (32) may preferably be pushed from the side into the T-groove at the transmitter. The buffer (15) sits loosely on the rod (32), so that the transmitter can oscillate freely. The buffers (15, 16) require no longitudinal grooves, since there is no screw (23) gripping therein serving to secure against turning.

The invention is not limited to the example of the drilling device shown, driven in a rotating and impacting manner by means of drill pipes, wherein drilling fluid is directed to the steering head. Rather, the invention may also be used in connection with a pile driver drilling device, operating in a pounding manner, as described, for example, in German Patent No. 2 157 259. In the case of a relatively small axial extent of the transmitter and a corresponding diameter of the drilling device, the transmitter may also be completely embedded in the impact-damping buffer, which may be removed in a problem-free manner for purposes of repair or maintenance.

We claim:

1. A drilling apparatus comprising:

a cylindrical shock-sensitive apparatus;

a housing with a chamber accommodating the shock-sensitive apparatus;

shock-absorbing buffers at respective ends of the shock-sensitive apparatus, at least one of the buffers having an axial hole with an undercut, the buffers having greater diameter than the shock-sensitive apparatus, the buffers holding the shock-sensitive apparatus at a distance from the walls of the chamber, at least in a main shock direction; and a pin, forming a head at its end, mounted on at least one end of the shock-sensitive apparatus, the pin and head extending into and engaging the hole and undercut of the buffer, whereby the buffer is attached to the shock-sensitive apparatus.

2. The drilling apparatus of claim 1, in which a buffer is arranged without rotational play at an end of the shock-sensitive apparatus, the buffer having a longitudinal groove on its outside, whereby a projection on the housing engages the groove as a rotation stop, and wherein an end of the shock-sensitive apparatus comprises a slot for positioning that is accessible through the axial hole in the buffer.

3. The drilling apparatus of claim 1, in which the buffer has annular grooves.

4. The drilling apparatus of claim 1, further comprising a shock-absorbing guide ring on the shock-sensitive apparatus adjacent the buffer.

5. The drilling apparatus of claim 1, further comprising a battery compartment in the shock-sensitive apparatus, the compartment comprising at least one battery with shock-absorbers arranged on its sides.

6. The drilling apparatus of claim 5, further comprising an arrangement of at least two batteries having poles, the batteries being arranged coaxially in the battery compartment, wherein the shock-absorbers are annular, and are positioned at both ends of the arrangement and between the coaxial batteries, whereby a pole of one battery contacts a pole from another battery through the shock-absorber.

7. The drilling apparatus of claim 1, wherein the shock-sensitive apparatus is a transmitter for locating a drilling apparatus moving in an underground drilled hole.

8. A drilling apparatus comprising:

a cylindrical shock-sensitive apparatus;

a housing with a chamber accommodating the shock-sensitive apparatus;

shock-absorbing buffers at respective ends of the shock-sensitive apparatus, at least one of the buffers having an axial hole, the buffers having greater diameter than the shock-sensitive apparatus, the buffers holding the shock-sensitive apparatus at a distance from the walls of the chamber, at least in a main shock direction;

a steering head connected to the housing; and a torsionally elastic guide bar having first and second ends, the first end connected without rotational play to the steering head, the second end connected without rotational play to the shock-sensitive apparatus.

9. The drilling apparatus of claim 8, wherein a tongue at the first end of the guide bar engages an end-face groove on the steering head, and a T-shaped projection at the second end of the guide bar engages a T-shaped groove on the shock-sensitive apparatus.

10. The drilling apparatus of claim 9, wherein the T-shaped projection in the T-shaped groove has axial play that is greater than a maximum resilient excursion of the buffer.

11. The drilling apparatus of claim 8, wherein the guide bar is arranged with play in the hole of the buffer, thereby permitting the shock-sensitive apparatus to oscillate without shocks being transmitted.

12. The drilling apparatus of claim 8, in which the buffer has annular grooves.

13. The drilling apparatus of claim 8, further comprising a shock-absorbing guide ring on the shock-sensitive apparatus adjacent the buffer.

14. The drilling apparatus of claim 8, further comprising a battery compartment in the shock-sensitive apparatus, the compartment comprising at least one battery with shock-absorbers arranged on its sides.

15. The drilling apparatus of claim 14, further comprising an arrangement of at least two batteries having poles, the batteries being arranged coaxially in the battery compartment, wherein the shock-absorbers are annular, and are positioned at both ends of the arrangement and between the coaxial batteries, whereby a pole of one battery contacts a pole from another battery through the shock-absorber.

16. The drilling apparatus of claim 8, wherein the shock-sensitive apparatus is a transmitter for locating a drilling apparatus moving in an underground drilled hole.

* * * * *